US008967428B2

(12) United States Patent
Kim

(10) Patent No.: US 8,967,428 B2
(45) Date of Patent: Mar. 3, 2015

(54) GUM DISPENSER FOR DISPENSING GUM BY VERTICAL LIFTING

(75) Inventor: Kang Cheal Kim, Seoul (KR)

(73) Assignee: ID Platech Co., Ltd, Gyeonggi-Do (KR)

( * ) Notice: Subject to any disclaimer, the term of this patent is extended or adjusted under 35 U.S.C. 154(b) by 159 days.

(21) Appl. No.: 13/382,904

(22) PCT Filed: Jan. 20, 2010

(86) PCT No.: PCT/KR2010/000366

§ 371 (c)(1),
(2), (4) Date: Jan. 6, 2012

(87) PCT Pub. No.: WO2011/004951

PCT Pub. Date: Jan. 13, 2011

(65) Prior Publication Data

US 2012/0111883 A1 May 10, 2012

(30) Foreign Application Priority Data

Jul. 6, 2009 (KR) ..... 10-2009-0061124

(51) Int. Cl.
*B65G 59/00* (2006.01)
*B65H 3/00* (2006.01)
(Continued)

(52) U.S. Cl.
USPC ..... 221/209; 221/163

(58) Field of Classification Search
CPC .... B65D 83/00; B65D 83/04; B65D 83/0005; B65D 83/0409; B65D 85/60; B65D 2583/044; B65G 47/1407; B65G 47/1428; B65G 47/1457; G07F 17/0092
USPC ..... 221/209, 163
See application file for complete search history.

(56) References Cited

U.S. PATENT DOCUMENTS 2,991,923 A * 7/1961 Wilson ..... 229/201
3,657,993 A * 4/1972 Close ..... 99/297
(Continued)

FOREIGN PATENT DOCUMENTS

JP 7-257557 3/1994
JP 2009-057060 8/2007
(Continued)

OTHER PUBLICATIONS

International Search Report for PCT/KR2010/000366 mailed Sep. 7, 2010.

*Primary Examiner* — Gene O. Crawford
*Assistant Examiner* — Rakesh Kumar
(74) *Attorney, Agent, or Firm* — AKC Patents, LLC; Aliki K. Collins

(57) ABSTRACT

The present invention relates to a gum dispenser for automatically dispensing gum by the vertical lifting of a gum case. Particularly, the present invention provides a container that has a self-sealing means, accurately dispenses a piece of gum one by one, prevents the generation of container defects, and provides ease of operation and molding. Currently, in the above operation structure, an inner case receiving gum therein is fitted in a lifting shaft of an outer case to be lifted or lowered so that a piece of gum is pushed up to an upper end of the lifting shaft, and then the gum is exposed to a dispensing hole perforated in a lid, which is coupled with the inner case, one by one for a user to enjoy. The above structure, however, has a disadvantage in that if two pieces of gum are lifted to the upper end of the lifting shaft and the lifting shaft is exposed to the perforated hole of the lid, then the lifting shaft and the dispensing hole correspond to each other 1:1 so that the two pieces of gum pop out, which makes the gum difficult to catch. In addition, if the lifting shaft is molded integrally with the outer case, the lifting shaft is likely to be twisted or bent due to the thickness thereof in the cooling procedure during the molding thereof so that it is difficult to achieve a precisely standing structure. Furthermore, if the inner case is repetitively lifted or lowered in the outer case, an outer force may be applied in the lifting motion according to a vacuum state, so that smooth operation becomes impossible and longer molding time is required in the molding. In addition, in the state that the lid is sealingly coupled with the outer case and the inner case for the sealing of the container during storage or delivery thereof, a perforated lid for implementing the dispensing hole may be pressed by the lifting shaft and the container may burst. If the perforated lid is formed to be thick in order to prevent the bursting, a pulling portion to be pulled for cutting the perforated lid is likely to be cut, and implementation of the dispensing hole may fail. As a result, the present invention is aimed at resolving the above problems.

2 Claims, 7 Drawing Sheets

(51) Int. Cl.
*B23Q 7/04* (2006.01)
*G07F 11/16* (2006.01)

(56) References Cited

U.S. PATENT DOCUMENTS

| | | | | | |
|---|---|---|---|---|---|
| 4,522,314 | A * | 6/1985 | Nelson | 221/190 |
| 4,650,853 | A * | 3/1987 | Carville et al. | 528/416 |
| 4,682,702 | A * | 7/1987 | Gach | 222/541.9 |
| 4,724,979 | A * | 2/1988 | Cleevely et al. | 220/258.2 |
| 5,635,233 | A * | 6/1997 | Levinson | 426/433 |
| 5,979,299 | A * | 11/1999 | Hornsby et al. | 99/297 |
| 6,098,838 | A * | 8/2000 | Saho et al. | 221/163 |
| 6,360,909 | B1 * | 3/2002 | Bridge | 220/258.2 |
| 2003/0070979 | A1 * | 4/2003 | Huang | 210/469 |
| 2003/0123919 | A1 * | 7/2003 | Gueret | 401/130 |
| 2005/0172814 | A1 * | 8/2005 | Brunk | 96/108 |
| 2005/0199129 | A1 * | 9/2005 | Glucksman et al. | 99/279 |
| 2005/0205618 | A1 * | 9/2005 | Mabee et al. | 222/541.9 |
| 2006/0151515 | A1 * | 7/2006 | Hood et al. | 221/29 |
| 2006/0249474 | A1 * | 11/2006 | Sawyer et al. | 215/256 |
| 2007/0257046 | A1 * | 11/2007 | Rault et al. | 220/675 |
| 2009/0039078 | A1 * | 2/2009 | Sanfilippo et al. | 220/4.27 |
| 2011/0100988 | A1 * | 5/2011 | Fraser et al. | 220/254.1 |
| 2012/0171333 | A1 * | 7/2012 | Crump et al. | 426/84 |

FOREIGN PATENT DOCUMENTS

| | | | |
|---|---|---|---|
| JP | 2009057060 | A * | 3/2009 |
| KR | 20-1998-0020579 | | 10/1996 |
| KR | 20-2001-0000441 | | 6/1999 |
| KR | 20-0340790 | | 2/2004 |
| KR | 20-0415343 | | 2/2006 |
| KR | 20-2008-0003947 | | 9/2008 |

* cited by examiner

GUM DISPENSER FOR DISPENSING GUM BY VERTICAL LIFTING

RELATED APPLICATIONS

This application is a 371 application of International Application No. PCT/KR2010/000366, filed Jan. 20, 2010, which in turn claims priority from Korean Patent Application No. 10-2009-0061124, filed Jul. 6, 2009, each of which is incorporated herein by reference in its entirety.

TECHNICAL FIELD

The present invention relates to a gum dispenser for dispensing gum with an up and down movement of a gum container which is characterized in that a container per se has a sealing part and makes it possible to precisely discharge a piece of gum at a time without having any defects in a container during an actual use or distribution and has easier operation and formation.

BACKGROUND ART

The gum formed in a tablet shape is sealingly stored in a container made from a plastic or the like; however the container has a disadvantage in that it is needed to take out one or more gums with fingers by opening a lid or a container is made upside down, thus taking out a certain number of gums. In this case, it is almost impossible to precisely take out a desired number of gums because the container is inherently designed to have only a storing function.

The Korean utility model registration number 424929 filed by the same applicant as the present invention is directed to overcoming the above problems and is basically designed to discharge a piece of gum at a time in such a way that a gum container is divided into an inner container and an outer container with the inner container being designed to move upward and downward.

The above structure is characterized in that with gums being stored in the inner container 10, the gums move upward and downward as they are caught by an up and down movement shaft 21 of the outer container 20, the gums are placed one by one on a support stopper 22 secured to an upper side of the up and down movement shaft 21, a piece of gum is discharged through a discharge hole 31 formed at the lid 30 secured to the inner container 10, thus taking out the gum.

In the above constructions, there are disadvantages in that with the gums being filled in the inner container, when two gums are placed on the support stopper 22 secured to the upper side of the up and down movement shaft 21, the discharge hole 31 formed at the lid 30 match one to one with the support stopper 22 of the up and down movement shaft, which prevents the gum from being discharged.

When the up and down movement shaft 21 is molded integral with the outer container 20, cuttable pieces 21*a* are formed as the up and down movement shaft 21 is divided at regular intervals so as to accommodate a moisture absorbent at the up and down movement shaft in an attempt to prevent the gums stored in the inner container 10 from being moisturized. In this case, it is impossible to manufacture an up and down movement shaft in a precise upright posture since it might be bent inwardly or might be curved owing to a distortion in the course of a cooling procedure due to the nature of plastic.

While the inner container 10 repeatedly moves upward and downward along the up and down movement of the outer container 20, vibrations occur, which make a smooth operation impossible. In addition, a lot of formation time is needed during the formation procedure.

Since the lid 30 is concurrently secured to both the inner container and the outer container for sealing the container during the storage or transportation, the up and down movement shaft 21 of the outer container 20 pressurizes a cuttable cover 32 forming the discharge hole 31 of the lid 30, so a cutting line, which helps easily cut the cuttable cover 32, might be broken or the up and down movement might be bent. The cuttable cover 32 might not be cut off when pulling a pulling part 34 formed at the cuttable cover 32 by means of the above pressurization, in other words, the pulling part might be broken instead.

The support cover of the up and down movement shaft is in part exposed from the upper side of the discharge hole, with the cuttable cover 32 of the lid being removed for the gum which will be discharged as the inner container moves upward and downward in the outer container and can be easily picked up, thus pressurizing the cuttable cover of the lid.

DISCLOSURE OF INVENTION

Accordingly, it is an object of the present invention to overcome the problems encountered in a conventional gum dispenser which moves upward and downward.

To achieve the above object, the present invention is characterized in that wings inclined in an inward direction of a discharge hole of a lid in which an up and down movement shaft moves upward and downward are formed and divided, so when a gum is placed at an upper side of the up and down movement shaft and moves upward as the inner container moves upward and downward, a piece of gum can be placed on an upper side of the up and down movement shaft at a time with the aid of the inclined wings.

The up and down movement shaft is formed of a plurality of cut-away pieces, thus inserting a moisture absorbent into the interior of the up and down movement shaft, and at the same time, the center of each cut-away piece is made weight-balanced so as to prevent a distortion or a bending which occurs as the cut-away pieces are spaced apart, thus improving the uniformity in terms of cooling in the curse of its mold formation and enhancing an upright structure.

It is appreciated that a ventilation hole is formed at a support surface of the inner container so that an inner container can repeatedly move up and down along an up and down movement shaft of the outer container in an easier way.

The cuttable cover is more protruded than the basic surface of the lid for an easier cutting of the cuttable cover which is provided for sealing the lid and a reduction of defective products. A grooves is formed at a connection part where the pulling part cuts off the cuttable cover, which makes it possible to more easily cut off the cuttable cover when the pulling part is pulled.

ADVANTAGEOUS EFFECTS

The present invention is characterized in that gum can be precisely discharged one by one at a time, and no defects occur in terms of the gum in the course of distribution, and a reliable operation and a good molding performance can be provided.

BRIEF DESCRIPTION OF THE DRAWINGS

The present invention will become better understood with reference to the accompanying drawings which are given only by way of illustration and thus are not limitative of the present invention, wherein.

Figure 1:
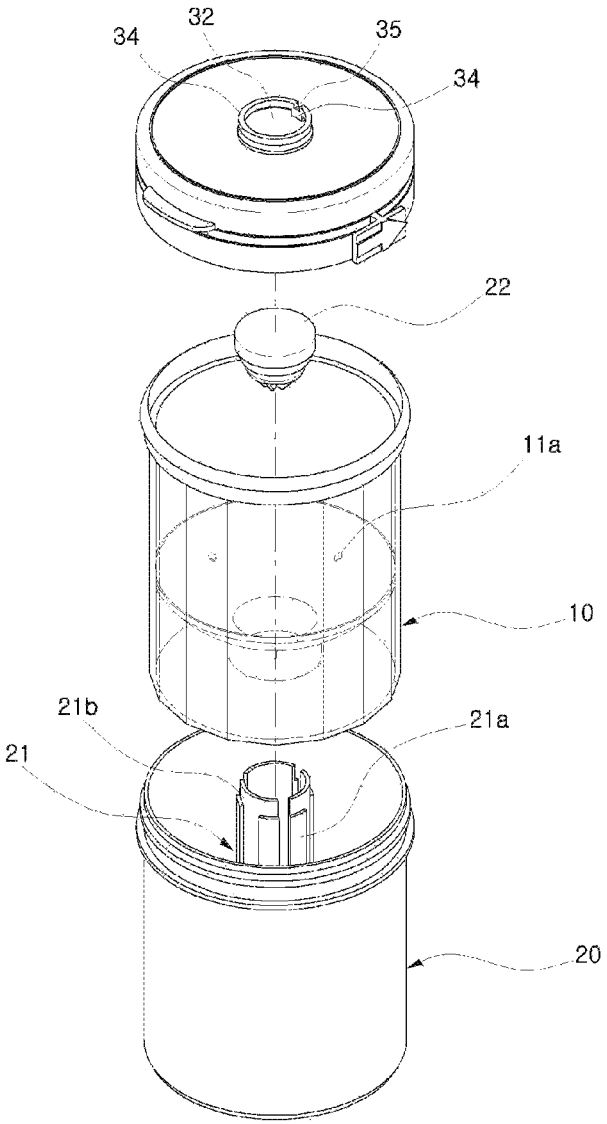
FIG. 1 is a disassembled perspective view illustrating an assembly structure according to the present invention.

<Descriptions of reference numerals of key elements>

| | |
|---|---|
| 10: inner container | 11: support surface |
| 11a: through hole | 12: up and down movement surface |
| 13: up and down movement hole | 14: reinforcing rib |
| 20: outer container | 21: up and down movement shaft |
| 21a: cut-away piece | 21b: engaging shoulder part |
| 22: support stopper | |
| 30: lid | 31: discharge hole |
| 32: cut-away cover | 32a: cutting line |
| 33: connection part | 34: pulling part |
| cut-away groove | 36: inclined wings |

BEST MODES FOR CARRYING OUT THE INVENTION

In the present invention, a gum dispenser for dispending gum by vertical lifting comprises an inner container 10 moving up and down as it is inserted in an up and down movement shaft 21 of an outer container 20; and a support stopper 22 being engaged to an upper side of the up and down movement shaft 21, with the gum being placed at its upper side one by one at a time, and the placed gum is discharged through a discharge hole 31 formed at a lid 30 tightly secured to the inner container 10, wherein the up and down movement shaft 21 is injection-molded integrally with the outer container 20, and the up and down movement shaft 21 is formed of a plurality of cut-away pieces 21*a* having cut-away spaces at regular intervals in such a way to store a moisture absorbent removing moisture from the gum stored in the inner container 10, thus accommodating the moisture absorbent in the interior, and a support stopper is detachably engaged to an upper side of the up and down movement shaft, thus preventing, by the support stopper, the inner container from freely escaping, and each cut-away piece 21*a* forming the up and down movement shaft 21 is thicker at a cut-away side with its center being thinner relatively.

Modes for carrying out the Invention

Figure 7:
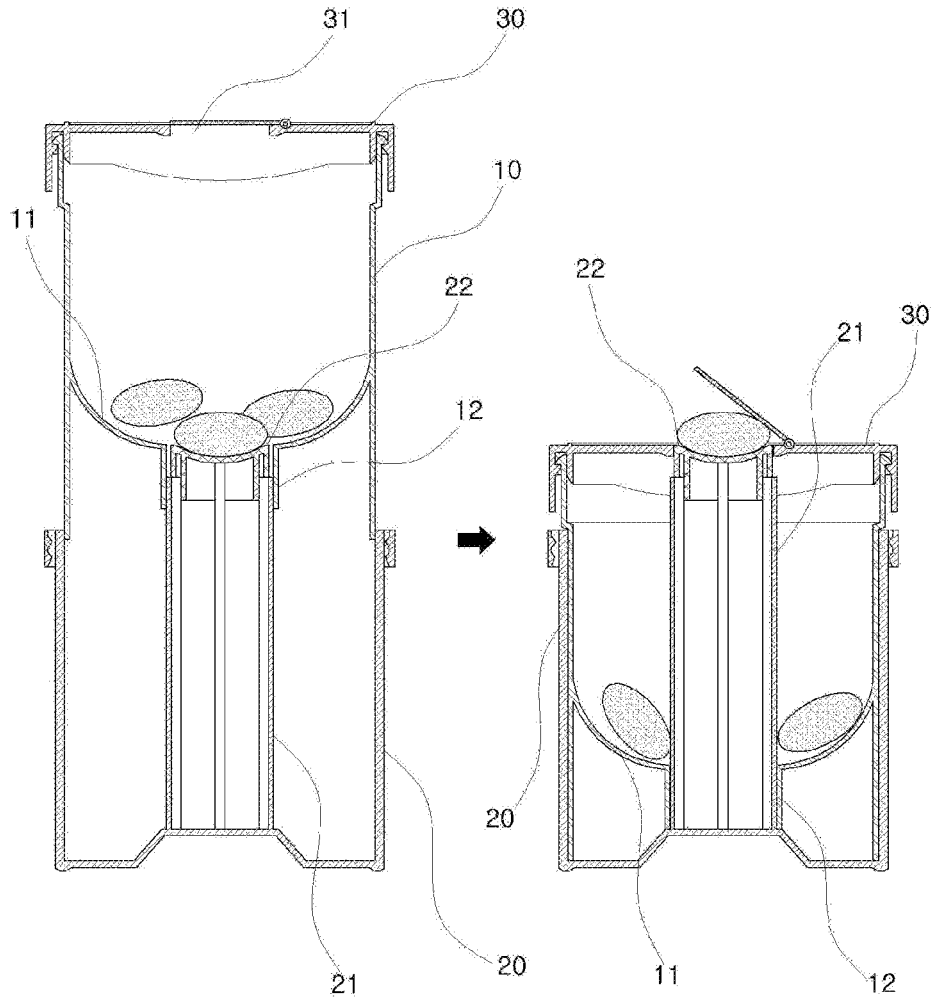
FIG. 7 is a view of an operation state of a conventional gum dispenser.

As shown in FIG. 7, the basic structure of the present invention is characterized in that with gum being stored in the inner container 10, it moves up and down as it is inserted into the up and down movement shaft 21 of the outer container 20, and a support stopper 22 is engaged to the upper side of the up and down movement shaft 21, and the escapes can be prevented while the inner container is engaged to the up and down movement shaft of the outer container, and gum is placed thereon one by one at a time, and the placed gum is discharged through the discharge hole 31 formed at the lid 30 stably secured to the inner container 10.

At the inner container 10 moving up and down along the up and down movement shaft 21 of the outer container 20 are formed a support surface 11 substantially curved to support gum and a up and down movement surface 12 with a certain surface area for preventing a leftward and rightward movement during the up and down movements.

Figure 6:
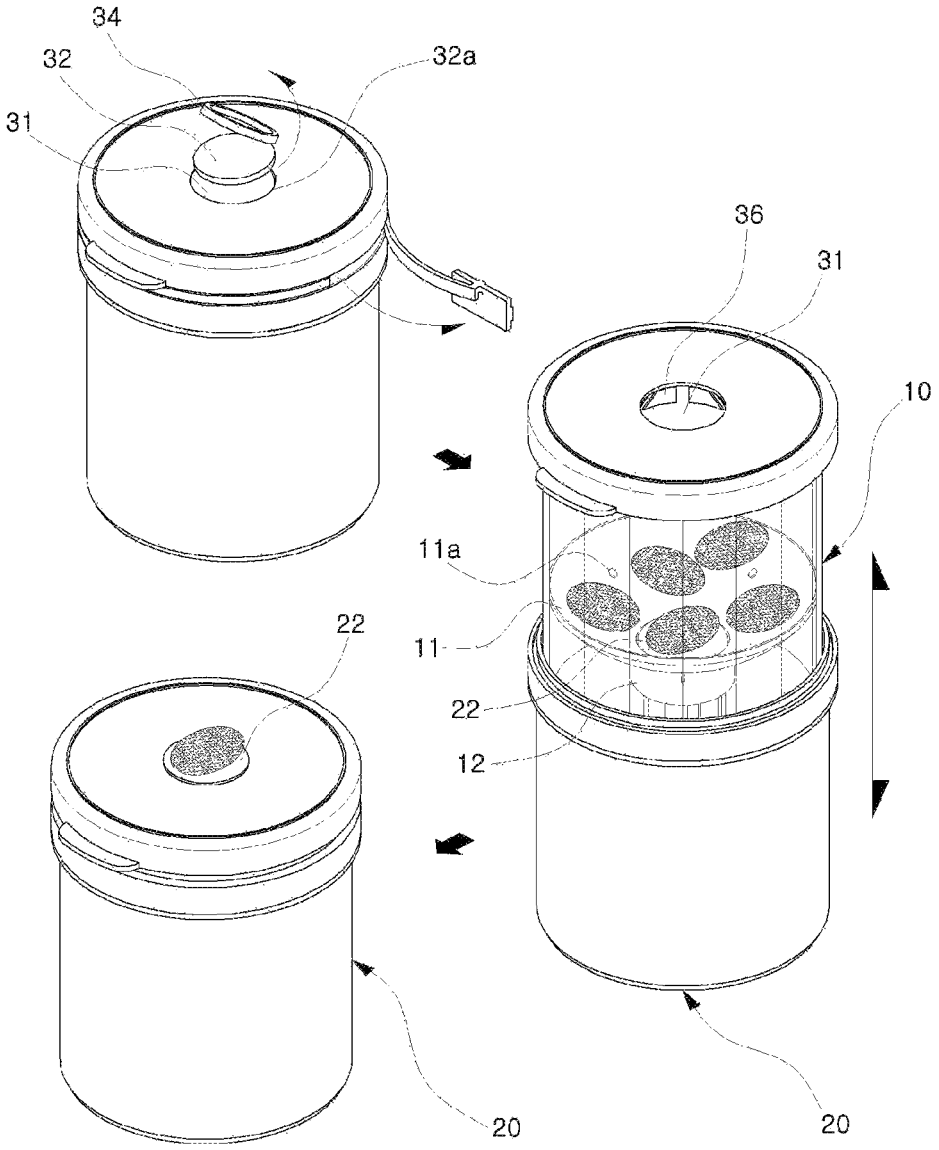
FIG. 6 is a view of an operation of a use start according to the present invention.

As shown in FIG. 6, the discharge hole 31 of the lid 30 keeps being covered by means of the cuttable cover 32 having a puling part 34 for cutting along the cutting line 32*a* and is integrally formed of the lid 30.

As shown in FIG. 1, the up and down movement shaft 21 is injection-molded integrally with the outer container 20, and the up and down movement shaft 21 is formed of a plurality of cut-away pieces 21*a* forming cut-away spaces at regular intervals in such a way to accommodate a moisture absorbent absorbing moisture from the gum stored in the inner container 10. An engaging shoulder part 21*b* is formed at an upper side of the up and down movement shaft 21 for engaging the support stopper 22.

Each cut-away piece 21*a* forming the up and down movement shaft 21 is formed with a thick thickness at left and right sides of the cut-away part with its center being thin, so the injection molding is easier, and a friction surface with the up and down movement surface 12 of the inner container is reduced, thus achieving an easier up and down movement.

Figure 4:
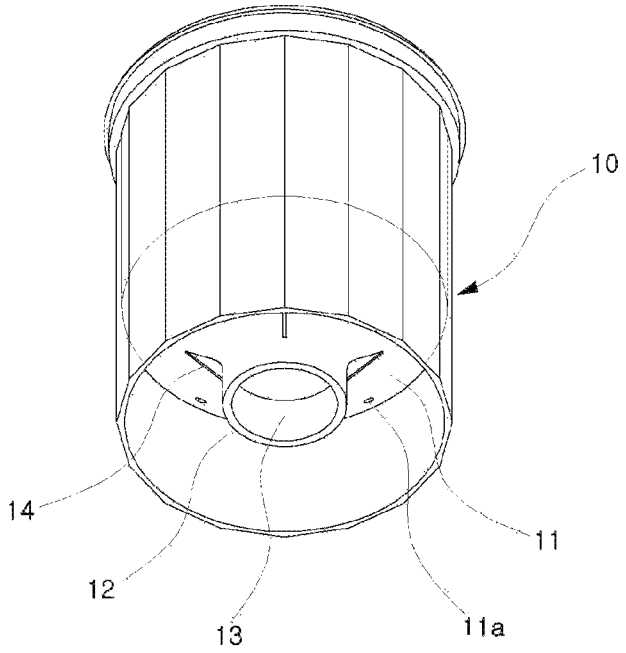
FIG. 4 is a perspective view illustrating a bottom surface of an inner container according to the present invention.

As shown in FIG. 4, the support surface 11 of the inner container 10 moving up and down as it is inserted into the up and down movement shaft 1 is inclined, so the gum stored in the inner container 10 naturally falls by its weight, and since the inclined portion are curved, and the rim portion of an up and down movement hole 13 rises a little, so the falling gum is prevented from gathering at the center of the up and down movement hole 13, and a plurality of through holes 11*a* are formed at the support surface 11 which provides an easier formation, and an air pressure problem at the up and down movement shaft 21 of the outer container 20 can be overcome during the up and down movements.

The up and down movement surface 12 is thicker than the inner container 10, and a reinforcing rib 14 is formed at an up and down movement surface and a backside surface of the support surface 11 of the inner container, so it is possible to overcome the problems that the up and down movement surface 12 does not move up or down due to contraction occurring as it is engaged with the outer container 20 while the gum is stored for a long time, and a deformation problems can be prevented as well, so a smooth up and down movement can be obtained.

Figure 2:
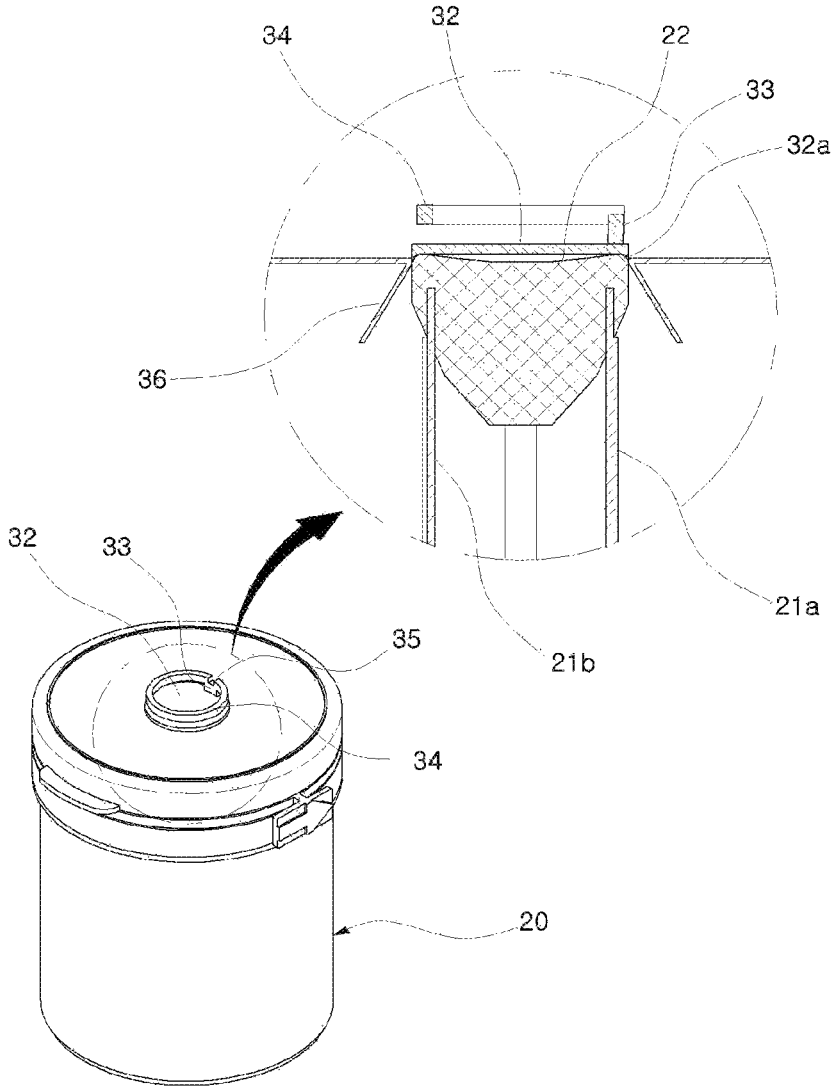
FIG. 2 is a cross sectional view illustrating a state that an up and down movement shaft comes into close contact with a lid according to the present invention.

As shown in FIGS. 2 and 6, the lid 20 engaged to the inner container 10 is also engaged with the outer container 20 in a sealing engagement way. When in use, the opening rim 37 is removed, and the outer container 20 and the inner container 10 are separated and move up and down. Here, the inner container 10 and the lid 30 are engaged in a sealing way.

As the inner container 10 moves up and down in the interior of the outer container 20, the discharge hole 31 formed at an upper side of the lid 30 and the cuttable cover 32 with a cutting line 32*a* are protruded a little higher than the upper surface of the lid 30 for the gum to be discharged one by one at a time. A cut-away groove 35 is formed at the connection part 33 connected with the cutting line 32*a* of the pulling part 34 so that the cutting line 32*a* can be easily cut when the pulling part 34 is pulled to cut the cuttable cover 32. In the above construction, when the pulling part 34 is pulled, the cut-away groove 35 becomes contracted, and then the cutting line 32*a* is first pulled, and then the cutting line 32*a* can be easily cut, thus preventing the damages of the pulling part 34.

Figure 3:
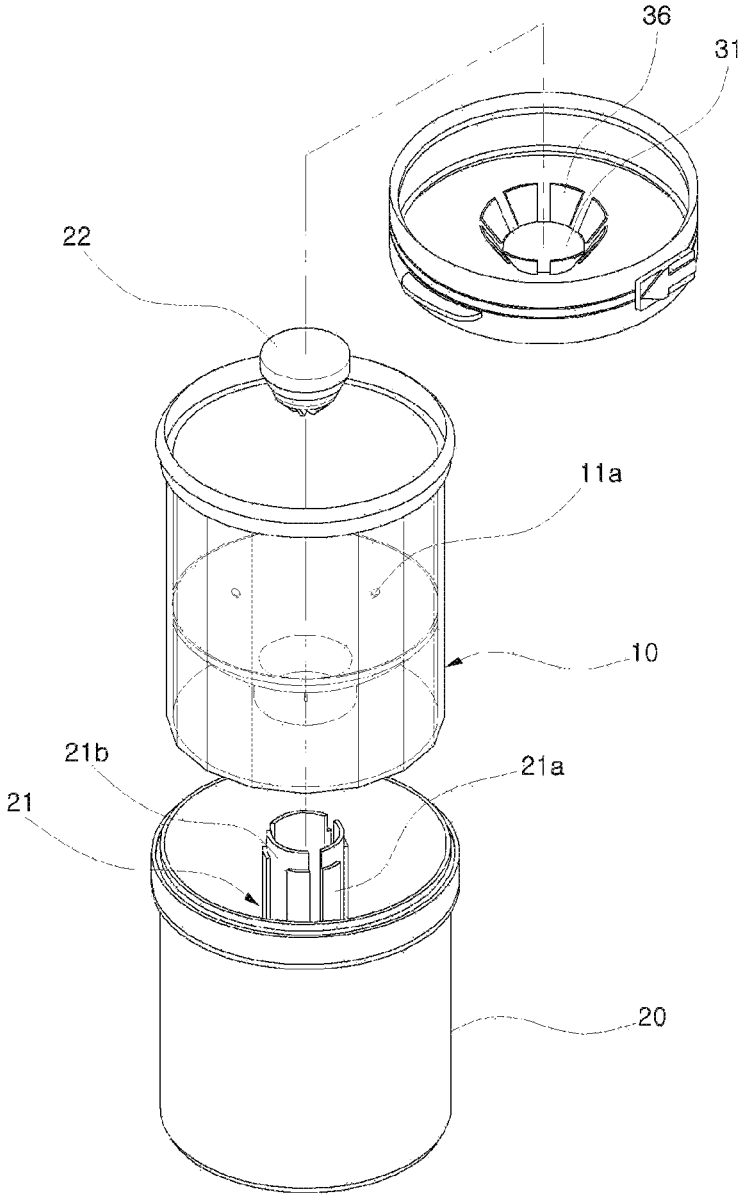
FIG. 3 is a perspective view illustrating a backside of a lid according to the present invention.
Figure 5:
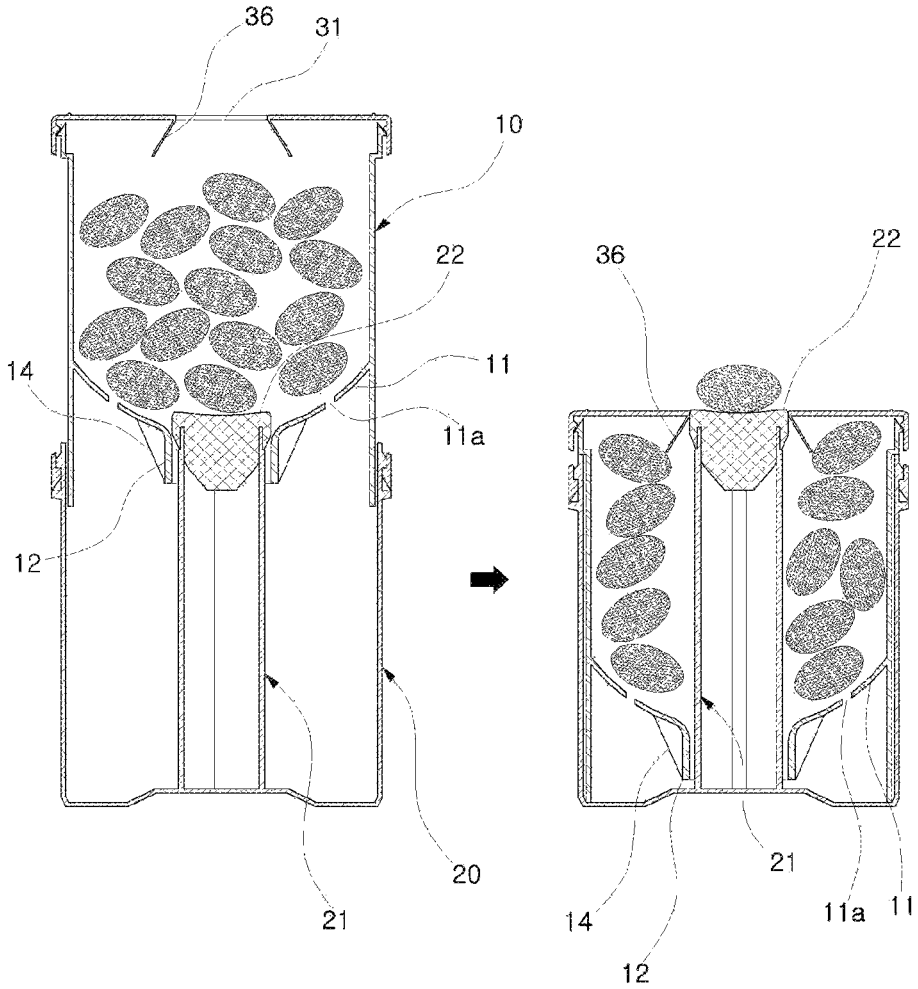
FIG. 5 is a cross sectional view illustrating an operation state of the present invention.

As shown in FIGS. 3 and 5, the inclined wings 36 inclined toward the inner side of the hole 31 of the lid 30 are separated, the construction of which helps precisely discharge the gum in such a way that when the inner container 10 moves up and down with a plurality of gum being placed at the upper surface of the up and down movement shaft in a state that the gum is fully filled in the inner container as the inner container 10 moves up and down, the gum can be placed one by one at a time at an upper side of the up and down movement shaft.

The invention claimed is:

1. A gum dispenser for dispending gum by vertical lifting, comprising:

an inner container moving up and down as it is inserted in an up and down movement shaft of an outer container; and a support stopper being engaged to an upper side of the up and down movement shaft, with the gum being placed at its upper side one by one at a time, and placed gum is discharged through a discharge hole formed at a lid tightly secured to the inner container, wherein said up and down movement shaft is injection-molded integral with outer container, and said up and down movement shaft is formed of a plurality of cut-away pieces having cut-away spaces at regular intervals, and a support stopper is detachably engaged to an upper side of the up and down movement shaft, thus preventing the support stopper and the inner container from freely detaching, and each cut-away piece forming the up and down movement shaft is thicker at a cut-away side with its center being thinner relatively, wherein the cut-away spaces of the plurality of cut-away pieces having cut-away spaces at regular intervals form separations between the cut-away pieces.

2. A gum dispenser for dispending gum by vertical lifting according to claim 1, wherein said support stopper is engaged to an engaging shoulder part formed at an upper side of the up and down movement shaft formed of a plurality of cut-away pieces.

* * * * *